US007775006B2

(12) United States Patent
Giannos

(10) Patent No.: US 7,775,006 B2
(45) Date of Patent: Aug. 17, 2010

(54) FIRE STOP SYSTEM FOR WALLBOARD AND METAL FLUTED DECK CONSTRUCTION

(76) Inventor: Konstantinos Giannos, 649 Patricia La., Des Plaines, IL (US) 60016

( * ) Notice: Subject to any disclaimer, the term of this patent is extended or adjusted under 35 U.S.C. 154(b) by 790 days.

(21) Appl. No.: 11/323,925

(22) Filed: Jan. 3, 2006

(65) Prior Publication Data

US 2007/0175140 A1 Aug. 2, 2007

(51) Int. Cl.
*E04B 1/94* (2006.01)

(52) U.S. Cl. ..... 52/241; 52/317; 52/236.7; 52/481.1

(58) Field of Classification Search ..... 52/317, 52/244, 245, 239, 243.1, 236.7
See application file for complete search history.

(56) References Cited

U.S. PATENT DOCUMENTS 3,397,495 A * 8/1968 Thompson et al. ..... 52/241
3,481,090 A * 12/1969 Lizee ..... 52/241
3,977,144 A 8/1976 Jahn
4,008,187 A 2/1977 Turley
4,123,575 A 10/1978 Wesch et al.
4,154,030 A 5/1979 Huguet
4,338,374 A 7/1982 Neser
4,458,460 A * 7/1984 Kohaut ..... 174/482
4,478,018 A 10/1984 Holland
4,486,553 A 12/1984 Wesch
4,631,884 A 12/1986 Reynolds
4,831,808 A 5/1989 Wynar
4,837,999 A 6/1989 Stayner
4,850,169 A 7/1989 Burkstrand et al.
4,866,900 A 9/1989 Dunn
4,936,064 A 6/1990 Gibb
5,022,210 A 6/1991 Scott
5,301,475 A 4/1994 Stefely
5,447,002 A * 9/1995 Wehrmann ..... 52/239
5,456,050 A * 10/1995 Ward ..... 52/220.8
5,666,775 A 9/1997 Shreiner et al.
5,755,066 A * 5/1998 Becker ..... 52/241
5,913,788 A * 6/1999 Herren ..... 52/241
6,058,668 A * 5/2000 Herren ..... 52/241
6,102,641 A 8/2000 Hildebrandt
6,112,488 A 9/2000 Olson et al.
6,128,874 A 10/2000 Olson et al.
6,189,277 B1 * 2/2001 Boscamp ..... 52/317
6,216,410 B1 4/2001 Haberman
6,260,318 B1 * 7/2001 Herren ..... 52/317

(Continued)

*Primary Examiner*—Richard E Chilcot, Jr.
*Assistant Examiner*—Alp Akbasli
(74) *Attorney, Agent, or Firm*—Scherrer Patent & Trademark Law; Stephen T. Scherrer

(57) ABSTRACT

The present invention describes a fire stop system for wall board construction. The patent addresses the problem of a gap between the head of a wall and a metal fluted deck. Described here-in is a fire resistance assembly made of multiple components of: a fire stop panel and a mounting channel. The fire stop panel or wall has a wallboard geometry manufactured to match the contour shape of a metal fluted deck in a "cookie cutter" fashion. This provides the advantages of saving time and material of wallboard construction, with a product that is novel, simple, and easy to manufacture and implement. The mounting channel of the fire stop system provides for an effective way to provide compliance of the stresses from the roofing/ceiling deck's stresses, easy assembly of the fire stop system, while allowing for a meeting of the fire safety rating.

18 Claims, 7 Drawing Sheets

U.S. PATENT DOCUMENTS 6,470,635 B2 * 10/2002 Cornwall ..... 52/220.8
6,489,040 B1 12/2002 Rohlf et al.
6,691,478 B2 2/2004 Daudet et al.
6,755,907 B1 6/2004 Westerman
6,871,470 B1 * 3/2005 Stover ..... 52/648.1
6,929,875 B2 8/2005 Savoly et al.
7,043,880 B2 * 5/2006 Morgan et al. ..... 52/2.23
7,284,355 B2 * 10/2007 Becker et al. ..... 52/712
7,406,806 B2 * 8/2008 Hallissy et al. ..... 52/481.1
7,571,578 B2 * 8/2009 Moody et al. ..... 52/481.1
7,603,816 B1 * 10/2009 Hohmann, Jr. ..... 52/101
2003/0079425 A1 5/2003 Morgan et al.

* cited by examiner

Figures 4A, 4B, 5A, 5B
(prior art)
FIG. 5A
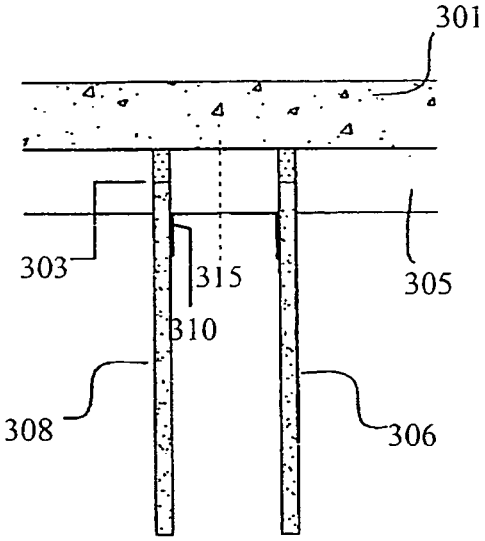
FIG. 5B
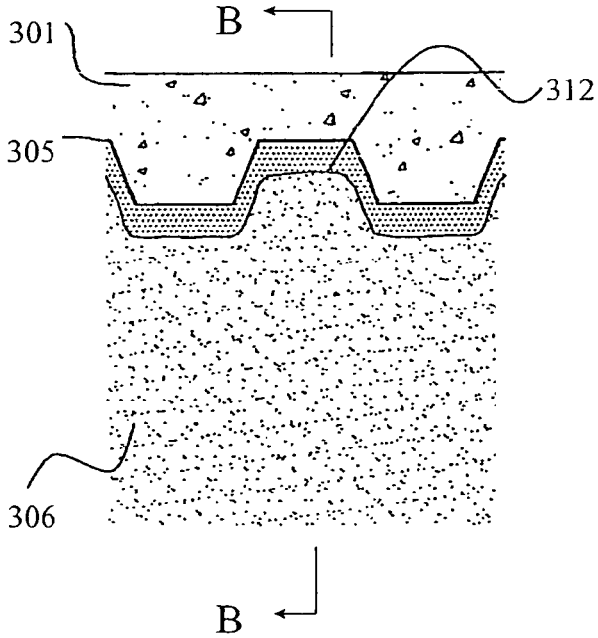
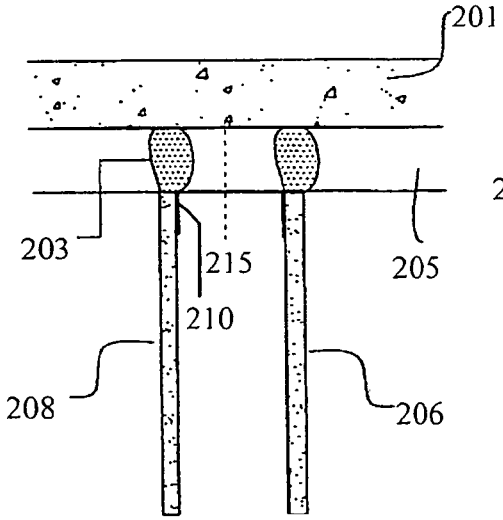
FIG. 4A
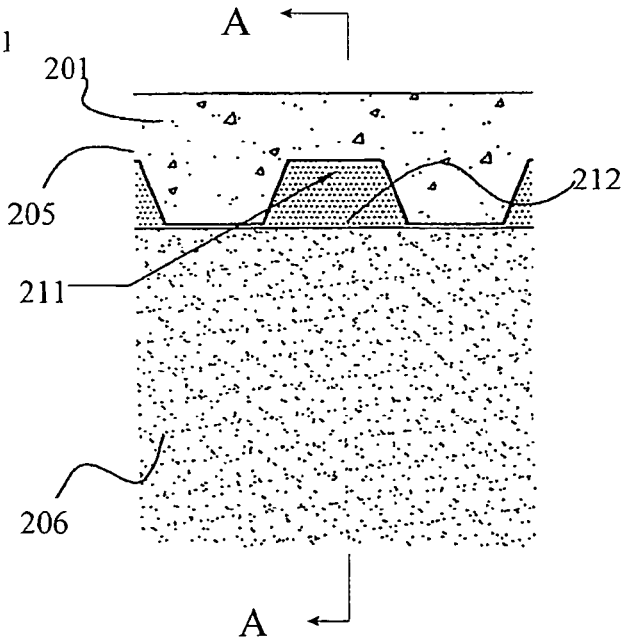
FIG. 4B

FIRE STOP SYSTEM FOR WALLBOARD AND METAL FLUTED DECK CONSTRUCTION

REFERENCES

U.S. Pat. No. 5,666,775 Shreiner, et al. Sep. 16, 1997
U.S. Pat. No. 6,102,641 Hildebrandt Aug. 15, 2000
U.S. Pat. No. 4,936,064 Gibb Jun. 26, 1990
U.S. Pat. No. 4,831,808 Wynar May 23, 1989
U.S. Pat. No. 5,301,475 Stefely Apr. 12, 1994
U.S. Pat. No. 6,128,874 Olson, et al. Oct. 10, 2000
U.S. Pat. No. 4,837,999 Stayner Jun. 13, 1989
U.S. Pat. No. 6,216,410 Haberman Apr. 17, 2001
U.S. Pat. No. 5,022,210 Scott * Jun. 11, 1991
U.S. Pat. No. 4,154,030 Huguet May 15, 1979
U.S. Pat. No. 4,478,018 Holand Oct. 23, 1984
U.S. Pat. No. 4,123,575 Oct. 31, 1978 Wesch, et al.
U.S. Pat. No. 4,486,553 Wesch Dec. 4, 1984
U.S. Pat. No. 4,338,374 Neser Jul. 6, 1982
U.S. Pat. No. 4,008,187 Turley Feb. 15, 1977
U.S. Pat. No. 6,755,907 Westerman, et al. Jun. 29, 2004
U.S. Pat. No. 6,929,875 Savoly, et al Aug. 16, 2005
U.S. Pat. No. 6,489,040 Rohlf, et al. Dec. 3, 2002
U.S. Pat. No. 6,112,488 Olson, et al Sep. 5, 2000
U.S. Pat. No. 6,691,478 Daudet, et al. Feb. 17, 2004
U.S. Pat. No. 4,866,900 Dunn Sep. 19, 1989
U.S. Pat. No. 4,850,169 Burkstrand, et al. Jul. 25, 1989
U.S. Pat. No. 3,977,144 Jahn Aug. 31, 1976
U.S. Pat. No. 4,631,884 Reynolds Dec. 30, 1986

TECHNICAL FIELD OF THE INVENTION

The present invention is directed to a fire resistant barrier for use in building structures; more particularly directed to a fire smoke resistant barrier at the interface at head of wallboard construction and ceiling/roofing metal fluted deck.

BACKGROUND OF THE INVENTION

A fire wall is composed of material that has the ability to resist fire. which subdivides a building or adjoins separate buildings, which under fire conditions has the ability to maintain structural integrity. If the fire wall requires a mounting or construction with multiple components, the device or method is usually called a fire-stop system or assembly. Determining the fire rating is usually not done analytically but rather experimentally. The ASTM (American Standard for the Testing of Materials), specifies testing standard for fire resistant materials, specifically with tests ASTME-814 and ASTME-E 119. The ASTME-814 test specifies furnace test for materials to establish fire ratings of specific materials, and ASTME-119 specifically for fire retardant wallboard structures. ⅝ inch gypsum wallboard. according to ASTM E119, should provide a one hour fire rating for a wall, column, slabs, floor; roof, ceilings, and wallboard structural components. In addition to ASTM standards local fire codes for municipalities and local governments are based on a large part on National Fire Protection Association (NFPA). The NFPA codes are categorized by type of fire hazard. The NFPA codes that specifically apply to this patent are:

NFPA 92A: Recommended practices for Smoke-Controlled Systems

NFPA203: Guide on Roofing Deck Coverings and Roof Deck Constructions

NFPA 221: Standard for Fire Walls and Fire Barriers

NFPA 251: Standard for Tests of Fire Endurance of Building and Construction and materials NFPA 101: Code for Life Safety from Burning Buildings and Fire Materials with various additives for increased structural strength, decreased weight, increased fire resistance, and other material properties are well documented within the literature. U.S. Pat. Nos. 4,008,187 4,123,575 4,338,374 4,486,553 by Turley, Wesch et al., Neser, and Wesch respectively. Turley defines a polyurethane foams are containing flame retardant additives; Where Neser's patent is for a fire proof material alkali and metal silicate solution. Each of these patents' scope is in regard to a specific materials and their method of manufacture. Each of Wesch's patent's are in regard to fireproof layered materials consisting of resin, disclose material properties and method of production.

Additives and material composition patents for gypsum wallboard specifically also exist in the prior art. One example is U.S. Pat. No. 6,755,907 by Westerman, et al., which describes a gypsum composition made with a styrene butadiene latex additive. The added latex makes the board lighter and less dense, while maintaining the strength of the wallboard. Also included in the literature are methods of manufacturing wallboard for improved properties. The U.S. Pat. No. 6,929,875 by Savoy, et al. invented a method of manufacture which includes dispersant and foaming agent combination for production of gypsum wallboard and other aqueous cementitious products; which has the benefit of more efficiently entrains air creating void space, and thereby lowering the board's weight without detrimentally affecting strength. A further improvement on the field is made in U.S. Pat. No. 6,489,040 by Rohlf, et al. Paper cover sheets usually dress gypsum wallboard. The wallboard usually had problems involving delaminating and peeling off of the wall paper sheets. The patent defines an additive of resin to improve adhesion of the paper to the wallboard. In addition to wallboard's chemical composition and manufacturing process, the materials necessary for sealing and joining wall boards are also part of the prior art. U.S. patent by Olson, et al., U.S. Pat. No. 6,112,488 define a fire barrier material for gaskets for architectural joints. The joining of two surfaces by an intumescent material creates an adhesion.

The patent disclosed herein may be comprised of any fire retardant or fire resistant material, although it is preferable that it be made for a gypsum wallboard construction. Use of a caulking material or intumescent coating in installation, although preferable, does not interfere with the scope of this patent. The wallboard should preferably have a paper coating, as described in the literature, and more specifically by Rolf, et al. However, to avoid peeling and adhesion problems on the dressing, it is preferable to have a metal stripe on the bottom of the invention to provide an aesthetic and functional dressing.

In addition to the patentability of materials, the prior art shows the patentability of pre-fabricated panels and methods of construction that either consist of fire proof or fire retardant materials. A patent by Stayner (U.S. Pat. No. 4,837,999) discloses an invention for a panel to be used as a prefabricated wall and/or roof panels having an inner and outer skin coupled to a center core are known in the art. The panel is specified to made of a material which will not become toxic in case of a fire. A further example of a prefabricated panel is described in U.S. Pat. No. 6,216,410 by Haberman, which discloses an invention for a prefabricated panel, which can provides a modular method of interlocking panel construction. U.S. Pat. Nos. 5,022,210, 4,154,030, 4,478,018 define systems of prefabricated methods of construction that involves components, interlocks and joints that interlock for making prefabricated buildings or rooms. All of these patent disclosed show how the shape and function of the wallboards, method of construction, and specified materials may provide distinct advantages in a novel fashion. They do not however address the specific problem of that this patent address, of filling structural gaps, and more specifically gap between a metal deck and head of a wallboard.

Methods of filling structural holes, gaps, and sealing for building surfaces exist by various methods, and is a major area of the prior art with numerous patents. One method for securing a wallboard panel, which has the advantage of providing a seal between wallboards by Wynar, in U.S. Pat. No. 4,831,808. Wynar describes a system of distortable mechanical clips made of a resilient material which secure wallboards. When joined, the seal in-between the wallboard forms a tight barrier in the surface of the built wall for fire and smoke. Furthermore as the gypsum wallboard distortions while retaining, the clip my mechanical means will readjust to maintain a fire and smoke proof seal longer. Another mechanism in wall board construction and construction in general is for a mechanical hole plugging device by Hildebrandt, in U.S. Pat. No. 6,102,641. The device described a method of installing hole plug consisting of at least two notched washers on a threaded shaft with a bolt head. One washer can be placed in hole to be repaired, and the other as a exterior washer providing support. The damaged section of the structure can then be sealed after tightening the device, making it fire and smoke retardant. A hole plug disclosed in U.S. Pat. No. 5,301,475, by Stefly, addresses a hole specifically for a fire stop device. Stefly addresses the problem of fire and smoke passing through structural walls where piping for conduit is passing through. The piping is normally lined with a caulking for improved fire retarding purposes. The invention describes a mechanical support layer where the base-plate of which automatically closes if the pipe where to melt improving the fire and smoke resistance.

The patents of Wynar, Stefly, Hildebrandt illustrate that mechanisms of construction, and devices for sealing structural holes are patentable innovations. However these devices do not define the scope of this invention, nor do they solve the problem of sealing the gap between the fluted deck and wall head of the wall to meet fire and smoke codes. While they contribute to the fire retardant integrity of the structure, they do not define the structure itself, or a panel which seals holes in structures.

U.S. Pat. No. 4,936,064 by Gibb, and U.S. Pat. No. 5,666,775 by Shreiner et al., and U.S. Pat. No. 5,301,475 by Olsen, et al. are indicative of patent where the scope includes novel application specific panels and methods of construction. Shreiner's and Olsen's inventions relate to a fireproof panel for closing openings in between structures, specifically for between walls and/or ceilings. The patents address the issue gaps in structures and goes on to claim the panel as a joint cover and method of joining. The patents continue to describe the benefits of noise level control, sustaining of earthquakes by allowing greater movement to occur, and fire proofing qualities. Olsen's patent differs in that the panel is multi-layer: one for mechanical support and the other a fire retardant material which has the advantage of replacing silicone caulking. While these patents describes a panel used in covering structural gaps, this panel's primary purpose is for a cover that acts as a cover for structural expansion joints prone to disturbance and stresses from earthquakes. Gibb's patent is for a more general applications which describes a fireproof panel for closing openings found within structures due to gaps in existing construction, or holes that must exist to allow for pipes, electrical conduits, and other hardware. The panel described a multi-layer panel with an exterior made of a reinforcing material for shape and structural integrity, and fire resistant filler. Gibb's goes on to define materials and the how the geometry may be varied to meet the specific application of panel, and further illustrates how the invention may be applied. Gibb's work could be used to fire-proof almost any gap, including the gap at the head of the wall board and fluted deck, as can any fireproof panel may be cut or shaped. However Gibb's primary purpose is to provide a means of construction to allow gaps caused by construction for electrical conduit, ducts, pipes, and other building service hardware, to be made aesthetically and structurally dressed while maintaining fire safety compliance. Gibb's patent would still be too time consuming, difficult to implement, and expensive to solve the problem of filling the gap at the head of the wall board and fluted deck. This present patent describes an application specific wall-board section which would increase the speed and decrease the cost in wallboard construction fireproofing, because of its specific of matching the gap in the deck.

Most construction of drywall panel involves having a plurality of joists, and having the wallboard nailed on to an existing frame. One patent in the literature by Daudet, et al. (U.S. Pat. No. 6,691,478) exists for a joist support apparatus. The invention describes a method of forming walls, floors, and ceiling wallboard construction frames. Many ceilings are suspended from roof decks and ceilings above. To form a ceiling that is structurally secure and fire safe various methods of construction and devices exist in the literature. Jahn describes such a system in U.S. Pat. No. 3,977,144. The ceiling panels are adapted to be successively installed in a suspended grid structure with reinforcing members secured by screws or a suitable adhesive to the associated panel. An example of further developments in the prior art are in U.S. Pat. No. 4,866,900 by Dunn describes a furring system for suspended ceilings that are interconnected and compliantly allow bending to relieve thermal expansion and has cross members formed of the channels. A similar invention in spirit is U.S. Pat. No. 4,850,169 by Burkstrand, et al. for a ceiling runner. The ceiling runner is comprised of an elongated generally U-shaped channel member having longitudinally spaced openings, each end portion is shaped to hold an upright C-stud therein. Essentially the patent describes a system of a particular geometry, for a runner to provide a structural support for a ceiling with wallboard panels.

While all these patents define construction fire safe methods for wallboard construction, they do not define walls that extend to the metal deck. Recent construction trends have wall extending fully, and new codes as described in NFPA regulations, must make the gap made between the metal deck and the head of the wall fire retardant and smoke retardant. A patent by Reynolds (U.S. Pat. No. 4,631,884) describes a building system for a curtain wall system with a finishing gasket means locking the infill in place, and having a wall extend up fully. But this patent is for a curtail type wall rather than a wallboard type construction, and does not solve the same problem as the present invention described herein. Prior art which approaches the problem of fireproofing the gap at head of wall and deck is the US application No. 20030079425 by Morgan, et al. The application describes a bag-like structure which fills gaps between ceiling and vertical walls (the problem addressed in this patent application), and other gaps and holes between walls. The method of which this application achieves this is by having a bag of sorts that is filled after construction with fire-retardant material creating a fire protecting barrier. The disadvantages of this patent are the complexity and cost. Although it solves the same problem, it also differs in approach. The work of this invention described herein, is for a pre-fabricated fire proof board which fits into the gap of the ceiling with a metal fluted deck and vertical head of wall gap.

OBJECTS AND ADVANTAGES OF THE INVENTION

The present invention contains specific objects and advantages that advance the prior art as described above in several ways:

(a) The pre-fabricated geometry of the fire-stop matching the gap of the metal fluted deck saves time and labor for wall board construction.

(b) The pre-fabricated geometry of the fire-stop matching the gap of the metal fluted deck saves material of filling and sealing the large gap necessary for ensuring a fire rating and the specified compression joint compression.

(c)The thickness of the fire stop allows for a fire-rating of one or two hours. (or any specified time and thickness rating specification necessary)

(d) Any fire rated material can be used and existing manufacturing processes for the specific material, thus making it simple and cost effective to manufacture.

(e) The metal J-channel allows for a dressed board for bare deck construction, providing an aesthetic appeal to the construction, and provides a dressing for falling of material.

(f) The mounting channel is easy to manufacture and implement for on site construction, and has the benefit of being out of the way of other mechanical, electrical, and other systems of buildings.

(g) Because of the material thickness and material, there is the added benefit of improving the noise-reduction characteristics of the spaces.

SUMMARY OF THE INVENTION

In accordance with the present invention of a fire stop system including: a pre-fabricated geometry deck specific fire-stop, a mounting channel, a method of construction which seals the gap at head of wall—metal deck interface. The present invention allows for a means of sealing the gap for smoke during fire, allows for a specified fire rating, allows for deck contraction and expansion, and reduces the time and cost of construction projects.

BRIEF DESCRIPTION OF THE FIGURES

The invention will be described further, by way of example, with reference to the accompanying drawings, in which:

FIGS. 2A, 2B, 2C and 2D are fragmentary plan views of the basic steelwork layout of the building.

FIGS. 4A and 4B are detailed illustrations of the prior art's construction method of a wall assembly at the head of the wall with the metal deck above.

FIGS. 5A and 5B are detailed illustrations of the prior art's construction method of a wall assembly at the head of the wall with the metal deck above.

DETAILED DESCRIPTION OF THE FIGURES AND PREFERRED EMBODIMENTS

Figure 1:
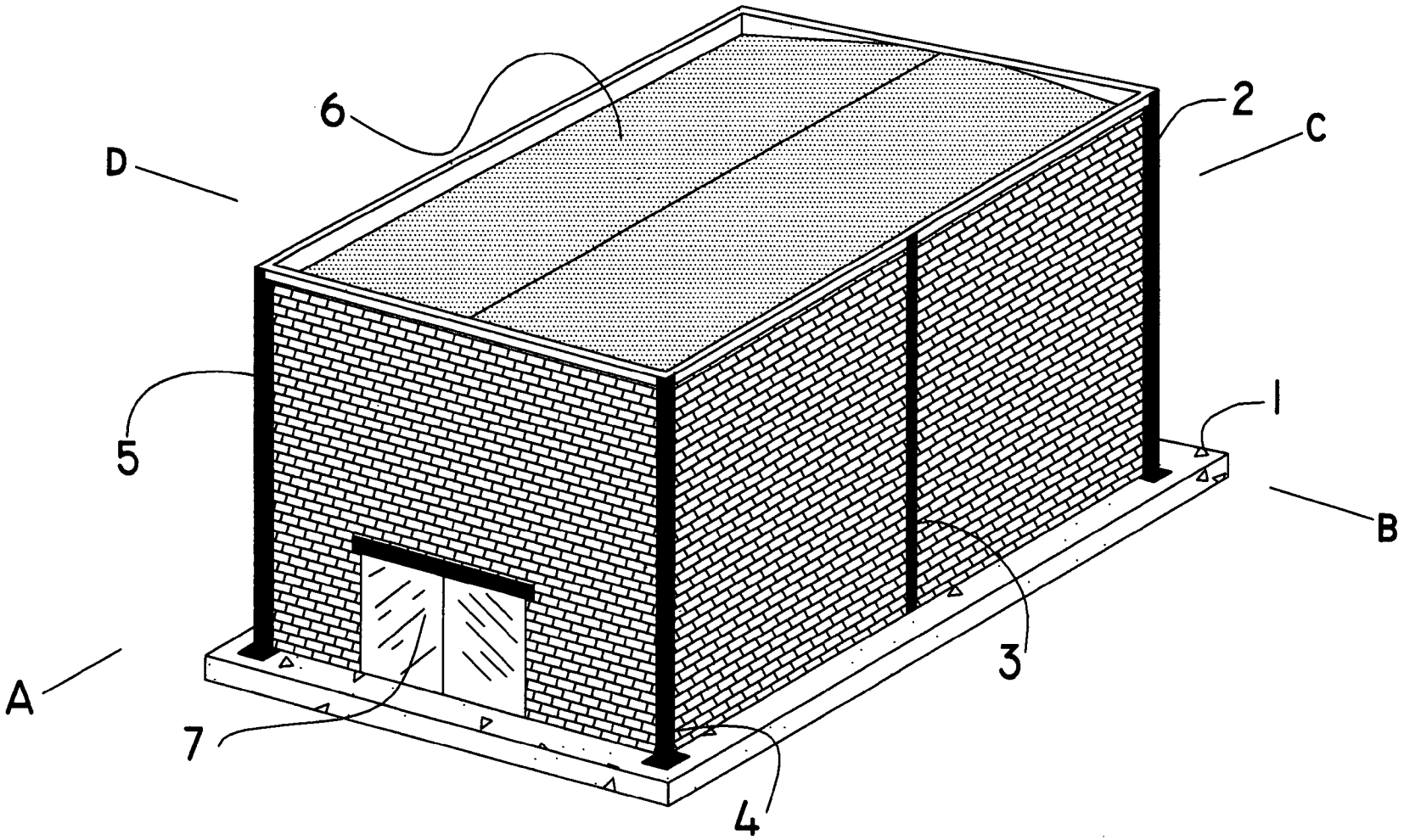
FIG. 1 is a diagrammatic perspective illustration of a typical building that may relay to the present invention, with some sections of the steelwork being shown, without the construction of auxiliary framework members and in-fills.

Static Descriptions of the Figures FIG. 1 is a diagrammatic perspective illustration of a typical building with steel and structural work. It is provided for general background and to assist the reader of the present invention with conceptualizing the patent. It is in no way to limit the patent's scope, only to provide an example for the application of the patent. The four sides of the building are labeled A, B, C, D, and components are labeled numerically one through seven. 1 represents the foundation for the building. 2, 3, 4, 5 are structural columns with an additional one not shown at the intersection of face C and D of the structure. Element 6 is the roof, and 7 is a typical door.

Figure 2A:
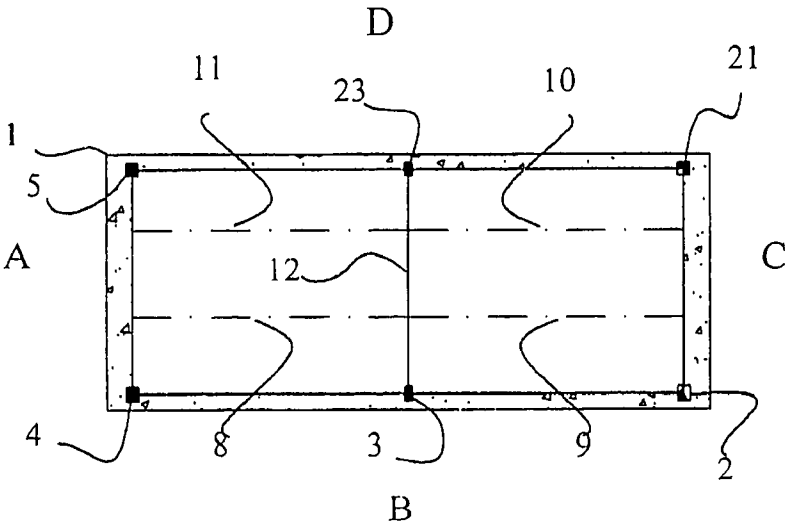
Figure 2B:
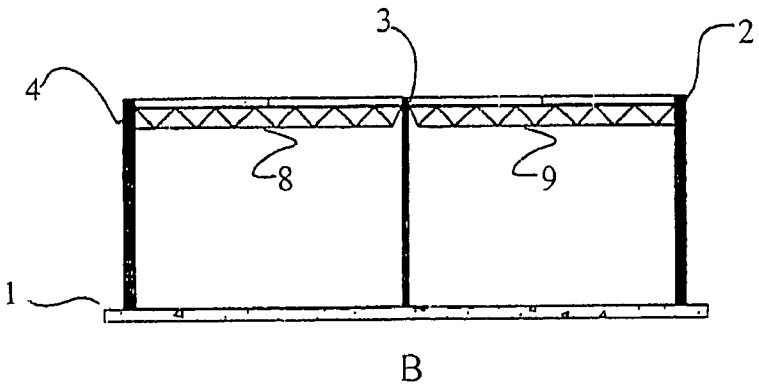
Figure 2C:
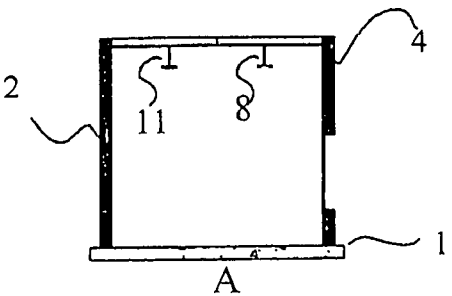

FIGS. 2A, 2B, and 2C illustrate a fragmentary plan view of the basic steelwork layout of the building shown in FIG. 1. FIG. 2 shows the alternating arrangement of the primary vertical columns, the secondary vertical columns, and roof and floor beams. The drawing has three views labeled FIGS. 2A, 2B and 2C. Each major element is labeled 1-11, 21 and 23, and are consistent with all three views. FIG. 2A represents a fragmentary top plan view, FIG. 2B a side elevation, and FIG. 2C is a front elevation. Element 1 is the foundation; 2, 3, 4, 5, 21 and 23 are structural columns; 8-11 represent roof-supporting joists.

Figure 3:
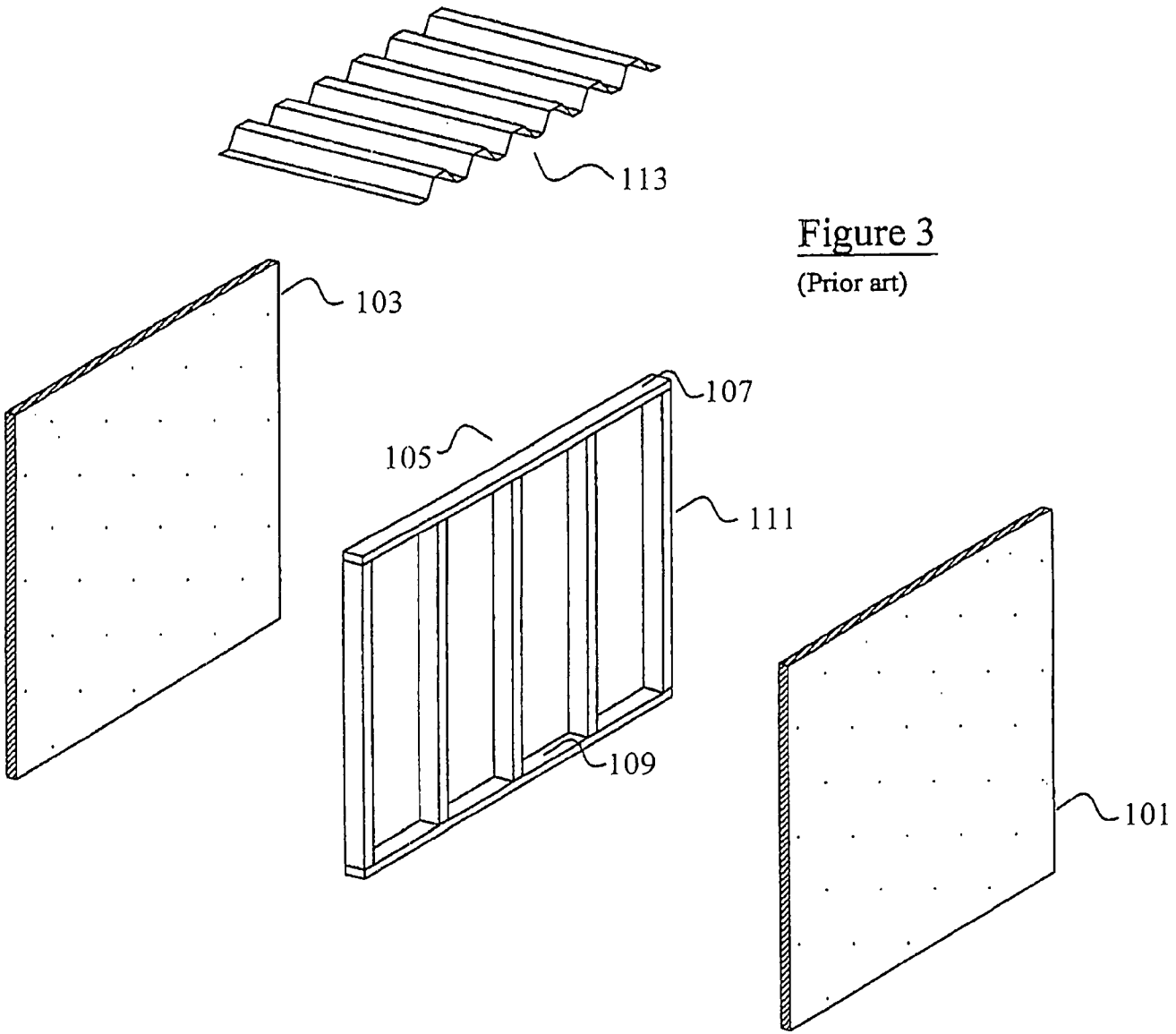
Figure 3 (Prior art)
FIG. 3 is an exploded perspective illustration view of the rudimentary construction of a wallboard and a section of a metal deck as described in prior art.

FIG. 3 is an exploded perspective illustration view of the rudimentary construction of a wallboard and a section of a metal deck. The elements 101 and 103 are the wall board sections secured on either side of the wall. 105 is the interior frame of the wall; 107 is the top of the frame; 109 is the bottom support anchored to the wall; 111 is one of the five studs in the frame. Element 113 is the metal deck above. The illustration is prior art given for reference.

FIGS. 4A and 4B are detailed illustrations of the prior art's construction method of a wall assembly at the head of the wall with the metal roofing or ceiling deck above. FIG. 4B is a front view of the head of wall construction, and FIG. 4A is a corresponding cross section view along line A-A. 201 is the floor or roof material that is above the metal deck; 203 is a dynamic joint as specified by structural engineer for the given roof; Element 205 indicates the metal deck; 206 is the wallboard, and in the cross section view the other wall board is labeled 208. Overlapping the stud on top of the frame of the wall is element 210, which is used to attach the wall to the metal roof; 212 is the head of the wall board In FIGS. 4A and 4B, the wallboard is flush with the lower member of the deck.

FIGS. 5A and 5B are detailed illustrations of the prior art's construction method of a wall assembly at the head of the wall with the metal roofing or ceiling deck above. FIG. 5B is a front view of the head of wall construction is shown, and FIG. 5A is a corresponding cross section view along line B-B. 301 is the floor or roof material that is above the metal deck; 303 is a dynamic joint as specified by structural engineer for the given roof; Element 305 indicates the metal deck; 306 is the wallboard, and in the cross section view the other wallboard is labeled 308. Overlapping the stud on top of the frame of the wall is element 310, which is used to attach the wall to the metal roof; 312 is the head of the wall board. In FIGS. 5A and 5B the wall is shown as a jagged cut.

Figure 6A:
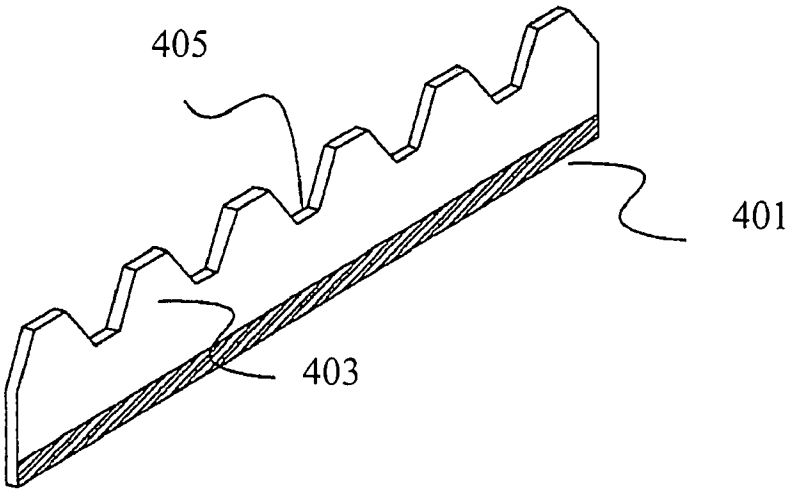
FIGS. 6A, 6B, and 6C are a perspective drawing, a front view and a side view illustration of the fire wall respectively.
Figure 6C:
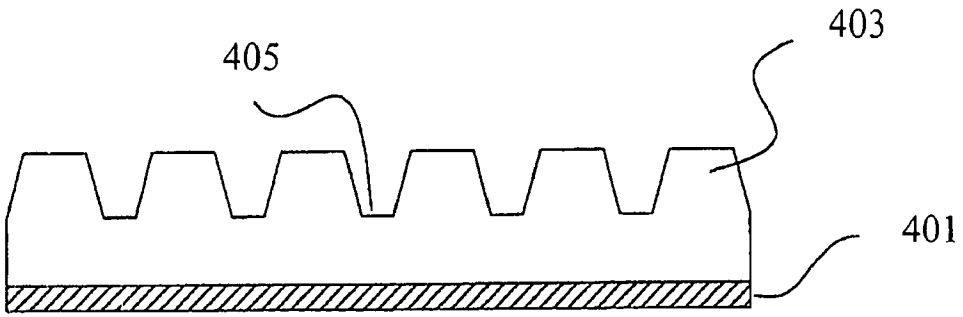
Figure 6B:
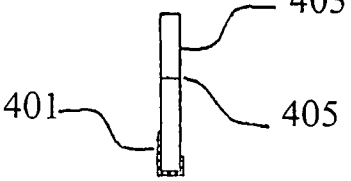

FIGS. 6A, 6B and 6C illustrate the fire wall of the present invention, and illustrate the major features in three views: FIG. 6A is a perspective illustration, FIG. 6B is a front view drawing, and FIG. 6C is a side view. In all three views the major elements are: the metal J-strip labeled 401, shown with hatched lines to indicate different material, the wallboard body labeled 403, and the specific geometry matching the specific deck labeled 405

Figure 7:
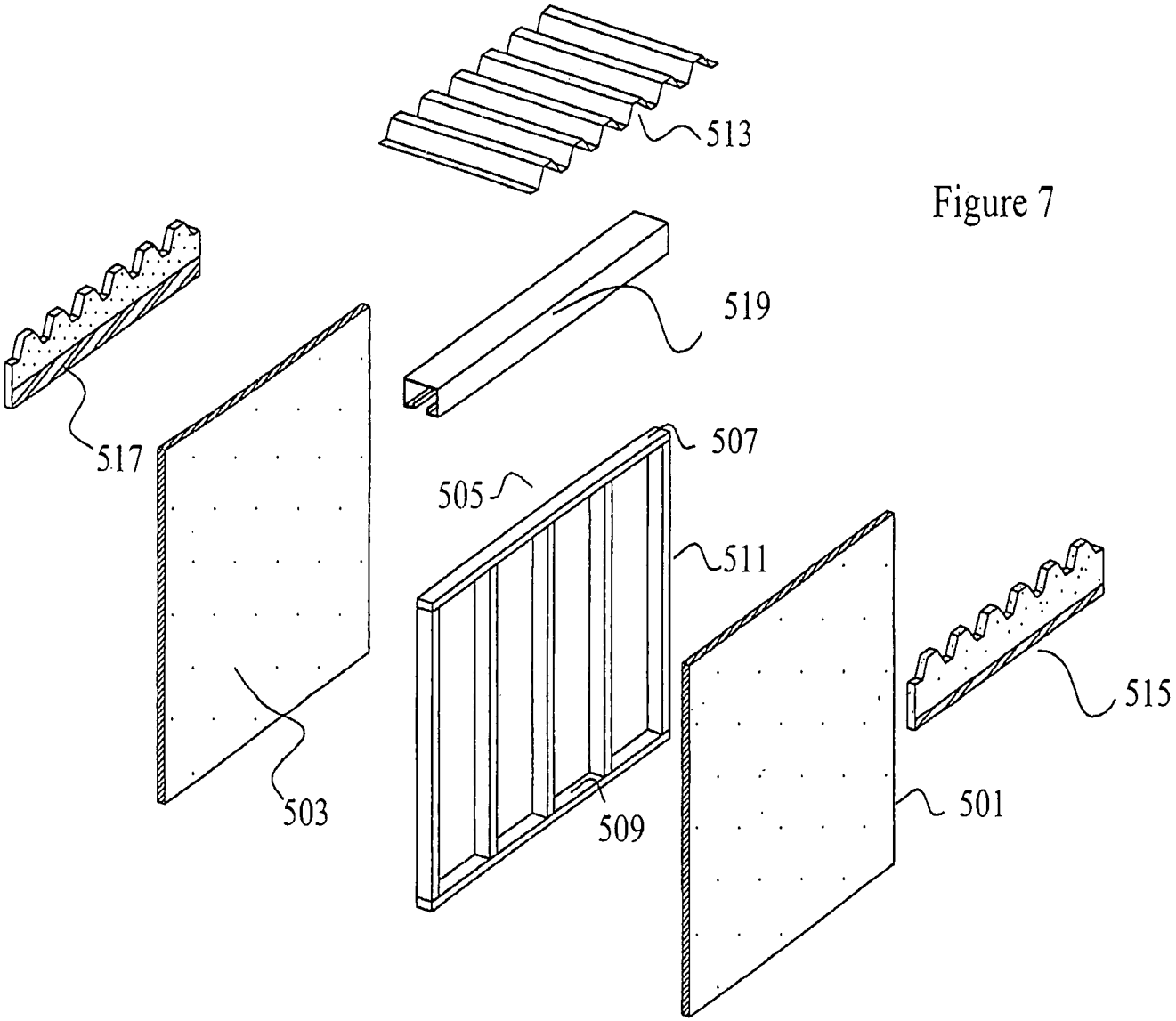
FIG. 7 is an exploded perspective illustration view of the rudimentary construction of a wallboard and a section of a metal for the present invention.

FIG. 7 is an exploded perspective illustration view of the rudimentary construction of a wallboard and a section of metal deck, as described in the present invention. The elements 501 and 503 are the wall board sections secured on either side of the wall. 505 is the interior frame of the wall; 507 is the top of the frame; 509 is the bottom support anchored to the wall; 511 is one of the five studs in the frame. Element 513 is the metal deck above. An example of the firewall as described in FIG. 6 is shown in elements 515 and 517; along with a channel, 519, on top of the wall so 515 and 517 can be mounted. The dotted line shows how the figure is connected to the metal deck.

Figure 8B:
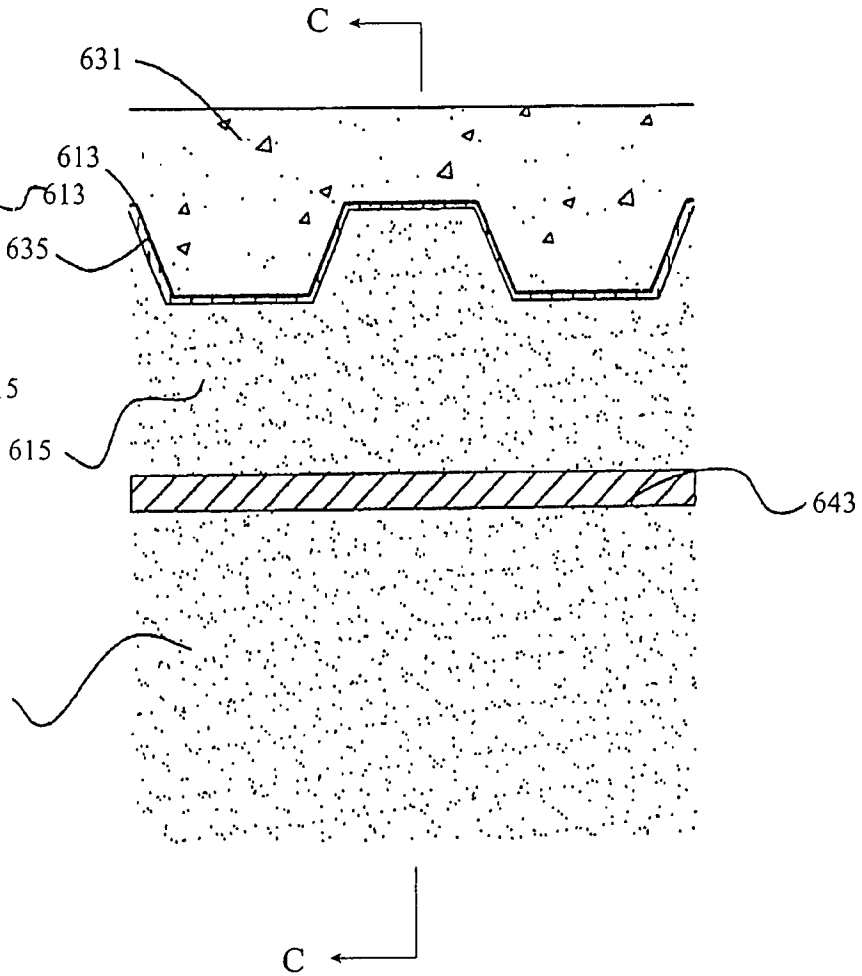
FIGS. 8A and 8B are detailed illustrations of the present invention's construction method of a wall assembly at the head of the wall with the metal deck above.
Figure 8A:
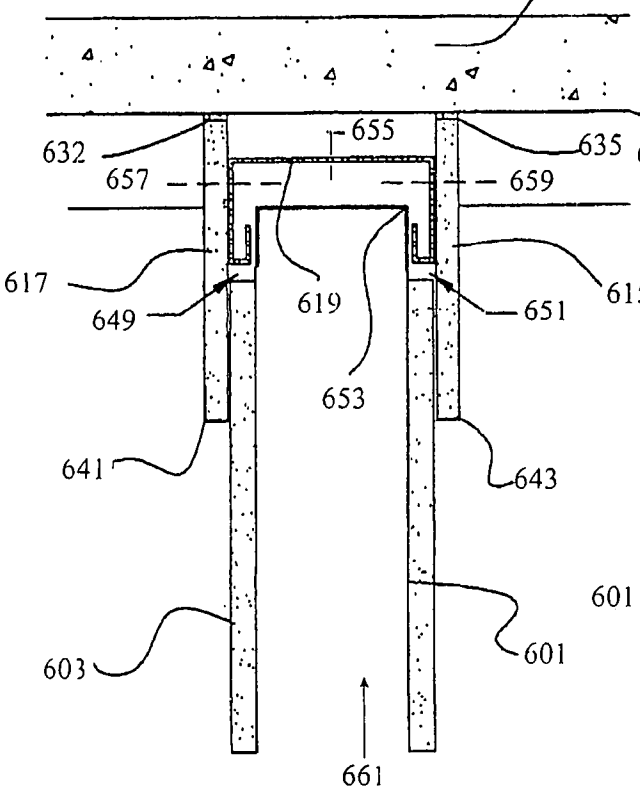

FIGS. 8A and 8B are detailed illustrations of the current invention construction method of a wall assembly at the head of the wall with the metal roofing or ceiling deck above. FIG. 8B is a front view of the head of wall construction is shown, and a corresponding cross section view along line C-C is shown in FIG. 8A. 631 indicates the material above the deck, either the roof or the floor above on the ceiling; 613 is a metal deck, and 615, and 617 make up the fire wall underneath the deck, sealed by a thin layer of silicone 632 and 635, respectively. The fire wall is shown on both sides of the wall indicated by 615 and 617. The J-channel is listed as element 643, and it is shown on each fire wall on either side of the wall in the cross section, FIG. 8A, as elements 643 and 641. The fire wall is shown overlapping 601, which represents a wallboard and is also shown on the other side of the cross section as 603. 619 is the channel for mounting the wall board which goes over the top of the wall section, 607, the studs are not shown and indicated as a stud void 661 in FIG. 8A. 615 is anchored in some fashion to the channel, 619. And 619 is then anchored to the metal deck 613. 649 and 651 are the compression joints, which is a free space, that allows for play of the deck. All surfaces should then be sealed.

DESCRIPTION OF PREFERRED EMBODIMENTS

FIG. 1 and FIG. 2 provide a background for the present invention. The present invention describes a novel fire wall system that applies to wallboard construction of buildings with roofing decks. Current construction methods no longer include hanging ceilings, and dividing walls extend to the metal deck above. This invention seeks to meet specific fire safety requirements for this type of building construction. FIG. 1 shows a perspective illustration of a typical building structure where this type of construction applies. Current methods of wallboard construction often call for the wall boards to extend from the floor (1) to the roofing deck under the roofing material (6). Within the second figure the structural components may be viewed. The fluted roofing deck is supported by elements structural columns (2-5, 21 and 23) and the support joists(8-11). The wall boards are placed parallel to the joist, and when placed under the deck create a gap between the metal deck and the head (or top) of the wall. The metal deck may also be for a ceiling if the building were to be a multi level building; however, this would be obvious to those skilled in building design and constructions. The specifications for these structures can vary depending on the type and size of the building being constructed and its intended use, local codes, structural requirements, e.g., whether it will be a restaurant, storage facility, a retail store, a factory, etc. However, since these factors are issues with which those skilled in building design and construction are quite familiar, and are only provided for reference. They will not be further discussed in any great detail.

The wallboard's fundamental construction is shown in FIG. 3. A hollow wall having a plurality of spaced vertical studs (111), wallboards affixed to both sides of the plurality of studs (101, 103), which) are fastened to the frame forming the wall, the height of the wallboard is made with the metal deck, as a section of which is shown, (111); The head of the wall, (107), and the deck are shown to have a gap which creates a fire safety hazard. In conventional wallboard construction methods, the wall is composed of a frame 105 (usually either metal or wood), and the wallboards are typically gypsum or drywall boards. To solve this problem, the present invention, describes a fire-wall which fills the gap, shown in FIG. 6.

In FIGS. 6A, 6B and 6C, an example of the fire stop is shown, with its basic elements. The board itself (403) should be comprised of a material and thickness to provide a specified fire rating, with a preferred embodiment being gypsum drywall board. The board is normally paper wrapped. A channel described as a J-channel (401) provides a guard against the adhesive losing its integrity, and allowing drywall to fall to the space below. In addition the J-channel, provides an aesthetic clean look to the wallboard, rather than a coarse construction. The geometry of the notch is to be a "cookie cutter" match of metal deck above, so that it may fit into the gap of the deck, and seal the head of the wall and fluted metal deck interface. From FIG. 7, we may see how the notches of (515, 517) the wallboard, fit into the gaps of the metal deck (513). However, it should be noted that the geometry shown is specific to the deck shape. It is a preferred embodiment of the present invention that the geometry be any shape to seal the head of the wall gap for any type of metal deck geometry. The fire stop should be mounted securely, and any other overhead construction elements such as sprinkler systems, cables, ducts, etc. The length and height of the fire-stop should be able to be easily handled by a single installer for ease, and long enough to be out of overhead construction elements as well. The construction should also allow for a method of construction that permits for compliance from roof stresses above. Traditional methods call for a compression joint, of fire-proof material to absorb these stresses, and allow for a fire resistance of the same rating as the board. Common methods of construction are shown in FIGS. 4A, 4B, 5A, and 5B.

A layer of gypsum wall board usually needs to be cut into the contour shape of the specific deck geometry FIG. 5B, elements 306 and 312) This leads to multiple problems, which give rise to the need to make a specific contour for each panel. This is very time consuming and wasteful in materials and timing. This is the purpose of the preferred embodiment shown in (403) of FIGS. 5A, 5B, and 5C. How the geometry will be improved in detail is illustrated in FIG. 8, where a simple seal of fire rated silicone, 635, is applied to the exterior of the wallboard, with the fire stop (615) closing the gap from the head of the wall to the metal deck (613). From the section of the said illustrations above (labeled as 213 in 4A and 313 in 5A), the compression joint of FIG. 5B, is very difficult if not impossible for the tradesman or inspector to see and guarantee a one hour minimum/specified rating. The need to cut the wallboard for each length to match the deck, and to fill the specified dimension (203 of FIG. 4A), accounts for a great deal of time and material loss, along with possible insufficiencies in the fire protection rating of the filled gap at the head of the wall and deck. In FIG. 4B, illustrates another typical method of construction by not cutting the wall into a "cookie cutter match" of the deck, by simply filling it with a fire stop material (206, 212); This would allow for a meeting of the required specification of the compression joint, but does so at material and labor waste. In addition there is no way to guarantee that the thickness is for the specified fire rating. It can be seen by inspection how the present invention guarantees a specified fire rating in the cross section of FIG. 8A, by having a fire-stop with the appropriate specified thickness for meeting the fire safety code requirements. To meet the need for compliance for both fire safety rating and stresses above, the compression joint is relocated from the dimension shown as (202 and 302) in FIGS. 4A and 5A, respectively, to the interior of the wall as shown as elements (649 and 651) in FIG. 8 of the present invention. The mounting channel shown as 619 in FIG. 8 and 519 in FIG. 7, illustrate how the fire stop wall will be mounted. The mounting channel will fit over the studs and mounted to the metal deck (shown as dotted lines labeled: 655, 657 and 659 in FIG. 8A). The gap between the boards underneath ((601 and 603) in FIG. 8 and (501 and 503 in FIG. 7) meet the specifications shown as (202 and 302) in FIGS. 4A and 5A respectively, with the added advantage of no need for a fire material to be applied, because of fire protection from the fire wall, which is mounted on the mounting channel. (shown as dotted lines labeled as 655, 657 and 659 adjoining fire wall to the channel in FIG. 8).

The mounting channel preferably should be made of a minimum of gauge galvanized steel, or some other material that meets possesses same structural integrity as the member. Mounting the fire stop wall on the outside although equivalent in function would not be as preferred as an internal method, because of possible difficulties in construction of the wall due to interference from other building mechanisms and/or systems. The fire wall preferably should be comprised of gypsum material meeting ASTM 814 material requirements. The manufacture of the fire wall may be a cutting of existing boards, or made from current methods of injecting materials to form a prefabricated panel. The assembly of the mounting channel and fire stop must meet ASTM E 119 fire and structural tests for a specified fire rating, as well as NFPA and other code requirements.

It should be noted that the specification and examples given in this description are not to limit the scope of the invention, but rather are provided to understand the spirit and scope of the present invention described here-in. Those knowledgeable in construction methods, buildings, and material arts are able to by reading the present invention and studying the prior art be able to implement the present invention. The scope of the present invention should be understood by the claims here-in.

What is claimed:

1. A fire stop wall extension apparatus comprising:

a U-shaped element having a length, the element having a base plate running the length of the element, a first side plate disposed downwardly from a first lateral edge of the base plate and a second side plate disposed downwardly from a second lateral edge of the base plate;

a first side wall having a length, a top edge and a bottom edge, the top edge of the first side wall having a first contoured geometry, wherein the first side wall is attached to the first side plate of the element;

a second side wall having a length, a top edge and a bottom edge, the top edge of the second side wall having a second contoured geometry, wherein the second side wall is attached to the second side plate of the element; and a first protective fitting disposed on the bottom edge of the first side wall and a second protective fitting disposed on the bottom edge of the second side wall.

2. The fire stop wall extension apparatus of claim 1 wherein the first side wall extends the length of the U-shaped element.

3. The fire stop wall extension apparatus of claim 2 wherein the second side wall extends the length of the U-shaped element.

4. The fire stop wall extension apparatus of claim 1 wherein the first side plate has an inwardly disposed flange at a bottom end of the first side plate, and further wherein the second side plate has an inwardly disposed flange at a bottom end of the second side plate.

5. The fire stop wall extension apparatus of claim 1 further comprising:

a deck disposed atop the first side wall and the second side wall, the deck having a contoured geometry wherein the contoured geometry of the deck generally mates with the first and second contoured geometries of the first and second side walls.

6. The fire stop wall extension apparatus of claim 5 wherein the deck is fluted.

7. A fire stop wall system comprising:

a wall having an internal frame having a first side and a second side, the internal frame having a plurality of vertically disposed studs, and a horizontally-disposed top plate connected to each stud;

a first wall board having a top end, a bottom end, an inner surface and an outer surface, the inner surface of the first wall board connected to the first side of the internal frame;

a first side wall having a length, a top edge, and a bottom edge, the top edge of the first side wall having a first contoured geometry wherein the bottom edge of the first side wall is disposed on the outer surface of the first wall board and overlaps the top end of the first wall board and further wherein the first sidewall comprises a first protective fitting disposed on the bottom edge of the first sidewall; and a deck disposed atop the first side wall, the deck having a contoured geometry that generally mates with the first contoured geometry of the top edge of the first side wall.

8. The fire stop wall system of claim 7 further comprising:

a second wall board having a top end, a bottom end, an inner surface and an outer surface, the inner surface of the second wall board connected to the second side of the internal frame; and a second side wall having a length, a top edge, and a bottom edge, the top edge of the second side wall having a second contoured geometry wherein the bottom edge of the second side wall is disposed on the outer surface of the second wall board and overlaps the top end of the second wall board, wherein the contoured geometry of the deck generally mates with the second contoured geometry of the top edge of the second side wall.

9. The fire stop wall system of claim 7 further comprising:

a U-shaped element having a length disposed above the top plate of the internal frame, the element further having a base plate running the length of the element, a first side plate disposed downwardly from a first lateral edge of the base plate, and a second side plate disposed downwardly from a second lateral edge of the base plate, wherein the first side wall is attached to the first side plate of the element.

10. The fire stop wall system of claim 9 further comprising:

a second wall board having a top end, a bottom end, an inner surface and an outer surface, the inner surface of the second wall board connected to the second side of the internal frame; and a second side wall having a length, a top edge and a bottom edge, the top edge of the second side wall having a second contoured geometry wherein the bottom edge of the second side wall is disposed on the outer surface of the second wall board and overlaps the top end of the second wall board, wherein the contoured geometry of the deck generally mates with the second contoured geometry of the top edge of the second side wall, wherein the second side wall is attached to the second side plate of the element.

11. The fire stop wall system of claim 7 further comprising:

A first protective fitting disposed on the bottom edge of the first side wall.

12. The fire stop wall system of claim 7 wherein the first side wall extends the length of the U-shaped element.

13. The fire stop wall system of claim 9 wherein the first side plate has an inwardly disposed flange at a bottom end of the first side plate, wherein the flange is disposed above a top end of the first wall board.

14. The fire stop wall system of claim 7 wherein the deck is fluted.

15. A method of forming a fire stop wall system comprising the steps of:

forming a wall extension comprising a U-shaped element having a length, the element having a base plate running the length of the element, a first side plate disposed downwardly form a first lateral edge of the base plate and a second side plate disposed downwardly from a second lateral edge of the base plate; the wall extension further comprising a first side wall having a length, a top edge, and a bottom edge, the top edge of the first side wall having a first contoured geometry, wherein the first side wall is attached to the first side plate; and the wall extension further comprising a second side wall having a length, a top edge, and a bottom edge, the top edge of the second side wall having a second contoured geometry, wherein the second side wall is attached to the second side plate, and further wherein the first sidewall comprises a first protective fitting disposed on the bottom edge of the first sidewall and the second sidewall comprises a second protective fitting disposed on the bottom edge of the second sidewall;

placing the wall extension atop a wall having an internal frame, a first wall board on a first side of the internal frame and a second wall board on a second side of the internal frame, wherein the first side wall of the wall extension overlaps the first wall board and the second side wall of the wall extension overlaps the second wall board;

providing a deck having a contoured geometry; and disposing the deck above the wall extension wherein the contoured geometry of the deck generally mates with the first and second contoured geometries of the first and second side walls.

16. The method of claim 15 further comprising the step of:

sealing the deck to the first and second side walls of the wall extension.

17. The method of claim 15 wherein the deck is a fluted deck.

18. The method of claim 15 further comprising the steps of:

providing a first inwardly disposed flange on a bottom end of the first side plate; and disposing the first inwardly disposed flange above a top edge of the first wall board.

* * * * *